US008967973B2

(12) United States Patent
Ingram

(10) Patent No.: US 8,967,973 B2
(45) Date of Patent: Mar. 3, 2015

(54) TURBINE BUCKET PLATFORM SHAPING FOR GAS TEMPERATURE CONTROL AND RELATED METHOD

(75) Inventor: Clint Luigie Ingram, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 604 days.

(21) Appl. No.: 13/282,074

(22) Filed: Oct. 26, 2011

(65) Prior Publication Data

US 2013/0108448 A1 May 2, 2013

(51) Int. Cl.
*F01D 11/02* (2006.01)
*F01D 5/14* (2006.01)

(52) U.S. Cl.
CPC ..... *F01D 5/143* (2013.01); *F05D 2240/80* (2013.01); *F05D 2250/184* (2013.01)
USPC ..... 416/191; 416/193 A

(58) Field of Classification Search
USPC ..... 416/193 A, 193 R, 189, 191, 192, 248, 416/239
See application file for complete search history.

(56) References Cited

U.S. PATENT DOCUMENTS 2,148,653 A * 2/1939 Semar ..... 416/248
3,014,695 A * 12/1961 Rankin et al. ..... 416/220 R
3,810,711 A * 5/1974 Emmerson et al. ..... 416/97 R
5,017,091 A * 5/1991 Tran ..... 416/193 A
5,853,286 A * 12/1998 Bussonnet et al. ..... 416/193 A
6,099,245 A 8/2000 Bunker
6,283,713 B1 * 9/2001 Harvey et al. ..... 416/193 A
6,413,045 B1 * 7/2002 Dancer et al. ..... 415/173.6
6,558,121 B2 * 5/2003 Zhu et al. ..... 416/193 A
7,008,178 B2 3/2006 Busch et al.
7,134,842 B2 11/2006 Tam et al.
7,189,063 B2 * 3/2007 Honkomp ..... 416/193 A
7,300,253 B2 * 11/2007 Beeck et al. ..... 416/193 A
7,329,096 B2 2/2008 Tomko et al.
7,334,306 B2 2/2008 Beverley et al.
7,341,427 B2 3/2008 Farmer et al.
7,354,243 B2 * 4/2008 Harvey ..... 415/191
7,429,164 B2 * 9/2008 Yamashita et al. ..... 416/190
7,465,152 B2 12/2008 Nigmatulin
7,470,109 B2 12/2008 Tomko et al.
7,708,528 B2 * 5/2010 Couch et al. ..... 416/193 A
8,231,353 B2 * 7/2012 Siden et al. ..... 416/193 A
2010/0028143 A1 * 2/2010 Bailey et al. ..... 415/202

(Continued)

OTHER PUBLICATIONS

U.S. Appl. No. 12/222,091, filed Aug. 1, 2008, pending.

*Primary Examiner* — Dwayne J White
*Assistant Examiner* — William Grigos
(74) *Attorney, Agent, or Firm* — Nixon & Vanderhye, P.C.

(57) ABSTRACT

A turbine bucket includes a radially inner mounting portion; a shank radially outward of the mounting portion; at least one radially outer airfoil having a leading edge and a trailing edge; a substantially planar platform radially between the shank and the at least one radially outer airfoil; at least one axially-extending angel wing seal flange on a leading end of the shank thus forming a circumferentially extending trench cavity along the leading end of the shank, radially between an underside of the platform leading edge and a radially outer side of the angel wing seal flange; and slash faces along opposite, circumferentially-spaced side edges of the platform. At least one of the slash faces is formed with a dog-leg shape, a leading end of the at least one of slash face terminating at a location circumferentially offset from the leading edge of the at least one radially outer airfoil.

29 Claims, 6 Drawing Sheets

(56) References Cited

U.S. PATENT DOCUMENTS

| | | | | |
|---|---|---|---|---|
| 2010/0080708 | A1 | 4/2010 | Gupta et al. | |
| 2010/0119364 | A1 | 5/2010 | Bunker | |
| 2010/0166558 | A1* | 7/2010 | Siden et al. | 416/193 R |
| 2011/0044818 | A1 | 2/2011 | Kuhne et al. | |
| 2011/0236200 | A1* | 9/2011 | Grover et al. | 415/208.1 |
| 2011/0299989 | A1* | 12/2011 | Richter | 416/189 |
| 2013/0004315 | A1* | 1/2013 | Beeck et al. | 416/193 A |

* cited by examiner

TURBINE BUCKET PLATFORM SHAPING FOR GAS TEMPERATURE CONTROL AND RELATED METHOD

BACKGROUND OF THE INVENTION

The present invention relates generally to rotary machines and, more particularly, to the control of forward wheel space cavity purge flow and combustion gas flow at the leading angel wing seals on a gas turbine bucket.

A typical turbine engine includes a compressor for compressing air that is mixed with fuel. The fuel-air mixture is ignited in a combustor to generate hot, pressurized combustion gases in the range of about 1100° C. to 2000° C. that expand through a turbine nozzle, which directs the flow to high and low-pressure turbine stages thus providing additional rotational energy to, for example, drive a power-producing generator.

More specifically, thermal energy produced within the combustor is converted into mechanical energy within the turbine by impinging the hot combustion gases onto one or more bladed rotor assemblies. Each rotor assembly usually includes at least one row of circumferentially-spaced rotor blades or buckets. Each bucket includes a radially outwardly extending airfoil having a pressure side and a suction side. Each bucket also includes a dovetail that extends radially inward from a shank extending between the platform and the dovetail. The dovetail is used to mount the bucket to a rotor disk or wheel.

As known in the art, the rotor assembly can be considered as a portion of a stator-rotor assembly. The rows of buckets on the wheels or disks of the rotor assembly and the rows of stator vanes on the stator or nozzle assembly extend alternately across an axially oriented flowpath for the combustion gases. The jets of hot combustion gas leaving the vanes of the stator or nozzle act upon the buckets, and cause the turbine wheel (and rotor) to rotate in a speed range of about 3000-15,000 rpm, depending on the type of engine.

As depicted in the figures described below, an axial/radial opening at the interface between the stationary nozzle and the rotatable buckets at each stage can allow hot combustion gas to exit the hot gas path and enter the cooler wheelspace of the turbine engine located radially inward of the buckets. In order to limit this leakage of hot gas, the blade structure typically includes axially projecting angel wing seals. According to a typical design, the angel wings cooperate with projecting segments or "discouragers" which extend from the adjacent stator or nozzle element. The angel wings and the discouragers overlap (or nearly overlap), but do not touch each other, thus restricting gas flow. The effectiveness of the labyrinth seal formed by these cooperating features is critical for limiting the undesirable ingestion of hot gas into the wheelspace radially inward of the angel wing seals.

As alluded to above, the leakage of the hot gas into the wheelspace by this pathway is disadvantageous for a number of reasons. First, the loss of hot gas from the working gas stream causes a resultant loss in efficiency and thus output. Second, ingestion of the hot gas into turbine wheelspaces and other cavities can damage components which are not designed for extended exposure to such temperatures.

One well-known technique for reducing the leakage of hot gas from the working gas stream involves the use of cooling air, i.e., "purge air", as described in U.S. Pat. No. 5,224,822 (Lenehan et al). In a typical design, the air can be diverted or "bled" from the compressor, and used as high-pressure cooling air for the turbine cooling circuit. Thus, the cooling air is part of a secondary flow circuit which can be directed generally through the wheelspace cavities and other inboard rotor regions. This cooling air can serve an additional, specific function when it is directed from the wheel-space region into one of the angel wing gaps described previously. The resultant counter-flow of cooling air into the gap provides an additional barrier to the undesirable flow of hot gas through the gap and into the wheelspace region.

While cooling air from the secondary flow circuit is very beneficial for the reasons discussed above, there are drawbacks associated with its use as well. For example, the extraction of air from the compressor for high pressure cooling and cavity purge air consumes work from the turbine, and can be quite costly in terms of engine performance. Moreover, in some engine configurations, the compressor system may fail to provide purge air at a sufficient pressure during at least some engine power settings. Thus, hot gases may still be ingested into the wheelspace cavities.

Angel wings as noted above, are employed to establish seals upstream and downstream sides of a row of buckets and adjacent stationary nozzles. Specifically, the angel wing seals are intended the prevent the hot combustion gases from entering the cooler wheelspace cavities radially inward of the angel wing seals and, at the same time, prevent or minimize the egress of cooling air in the wheelspace cavities to the hot gas stream. Thus, with respect to the angel wing seal interface, there is a continuous effort to understand the flow patterns of both the hot combustion gas stream and the wheelspace cooling or purge air. In addition, there is concern for the gap between the platforms of adjacent buckets, another potential avenue for hot combustion gas ingress.

For example, it has been determined that even if the angel wing seal is effective and preventing the ingress of hot combustion gases into the wheelspaces, the impingement of combustion gas flow vortices on the surface of the seal and/or on adjacent bucket surfaces may damage and thus shorten the service life of the bucket. Similarly, hot gas ingress into the gaps between platforms of adjacent buckets can lead to thermal degredation of the platform slash face edges and seals located between the buckets.

The present invention seeks to provide unique bucket platform geometry to better control the flow of secondary purge air at the angel wing interface and/or in the generally axially-oriented gap between the platform edges or slash faces of adjacent buckets, to thereby also control the flow of combustion gases in a manner that extends the service life of the bucket.

BRIEF SUMMARY OF THE INVENTION

In one exemplary but nonlimiting embodiment, the invention provides a turbine bucket comprising a radially inner mounting portion; a shank radially outward of the mounting portion; at least one radially outer airfoil having a leading edge and a trailing edge; a substantially planar platform radially between the shank and the at least one radially outer airfoil; at least one axially-extending angel wing seal flange on a leading end of the shank thus forming a circumferentially extending trench cavity along the leading end of the shank, radially between an underside of the platform leading edge and a radially outer side of the angel wing seal flange; and slash faces along opposite, circumferentially-spaced side edges of said platform, at least one of the slash faces having a dog-leg shape, a leading end of one said at least one slash face terminating at a location circumferentially offset from the leading edge of the at least one radially outer airfoil.

In another aspect, the invention provides a turbine wheel comprising a plurality of buckets in a circumferential array about the wheel, each bucket comprising a radially inner mounting portion, a shank radially outward of the mounting portion, a radially outer airfoil and a substantially planar platform radially between the shank and the radially outer airfoil; at least one axially-extending angel wing seal flange on a leading end of the shank thus forming a circumferentially extending trench cavity along the leading end of the shank, radially between an underside of the platform leading edge and a radially outer side of the angel wing seal flange; a slash face along opposite, circumferentially-spaced side edges of the platform, at least one of the slash faces having a dog-leg shape, wherein leading ends of the slash faces on adjacent buckets terminate at a location circumferentially offset from the leading edges of the adjacent radially outer airfoils.

In still another aspect, the invention provides a method of controlling purge airflow in a radial space between a leading end of a bucket mounted on a rotor wheel and a surface of a stationary nozzle, and wherein the turbine bucket includes a radially inner mounting portion; a shank radially outward of the mounting portion; at least one radially outer airfoil having a leading edge and a trailing edge; a substantially planar platform radially between the shank and the at least one radially outer airfoil; at least one axially-extending angel wing seal flange on a leading end of the shank thus forming a circumferentially extending trench cavity along the leading of the shank, radially between an underside of the platform leading edge and a radially outer side of the angel wing seal flange; and slash faces along opposite, circumferentially-spaced side edges of the platform, the method comprising forming opposed slash faces of adjacent buckets to have a substantial dog-leg shape in a substantially axial direction; and locating leading ends of the opposed slash faces circumferentially between leading edges of the respective radially outer airfoils.

The invention will now be described in detail in connection with the drawings identified below.

DETAILED DESCRIPTION OF THE INVENTION

Figure 1:
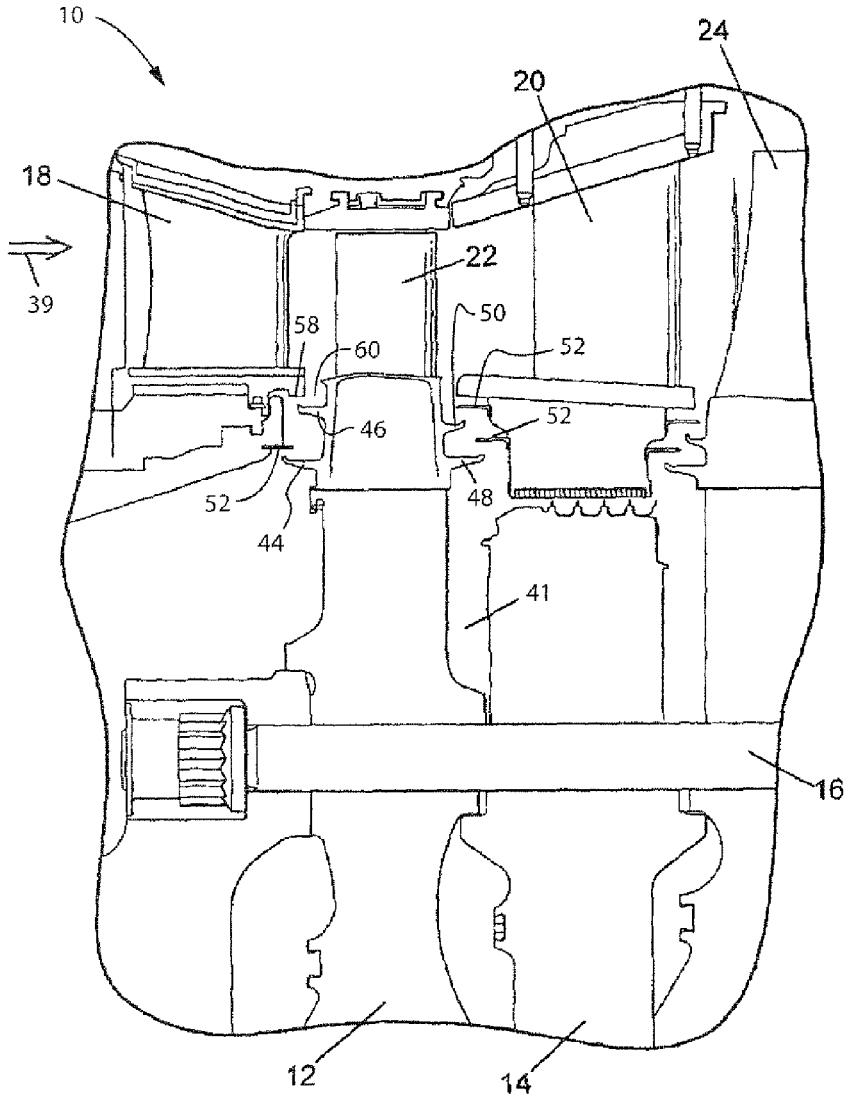
FIG. 1 (PRIOR ART)
FIG. 1 is a is a fragmentary schematic illustration of a cross-section of a portion of a turbine.

FIG. 1 schematically illustrates a section of a gas turbine, generally designated 10, including a rotor 11 having axially spaced rotor wheels 12 and spacers 14 joined one to the other by a plurality of circumferentially spaced, axially-extending bolts 16. Turbine 10 includes various stages having nozzles, for example, first-stage nozzles 18 and second-stage nozzles 20 having a plurality of circumferentially-spaced, stationary stator blades. Between the nozzles and rotating with the rotor and rotor wheels 12 are a plurality of rotor blades, e.g., first and second-stage rotor blades or buckets 22 and 24, respectively.

Figure 2:
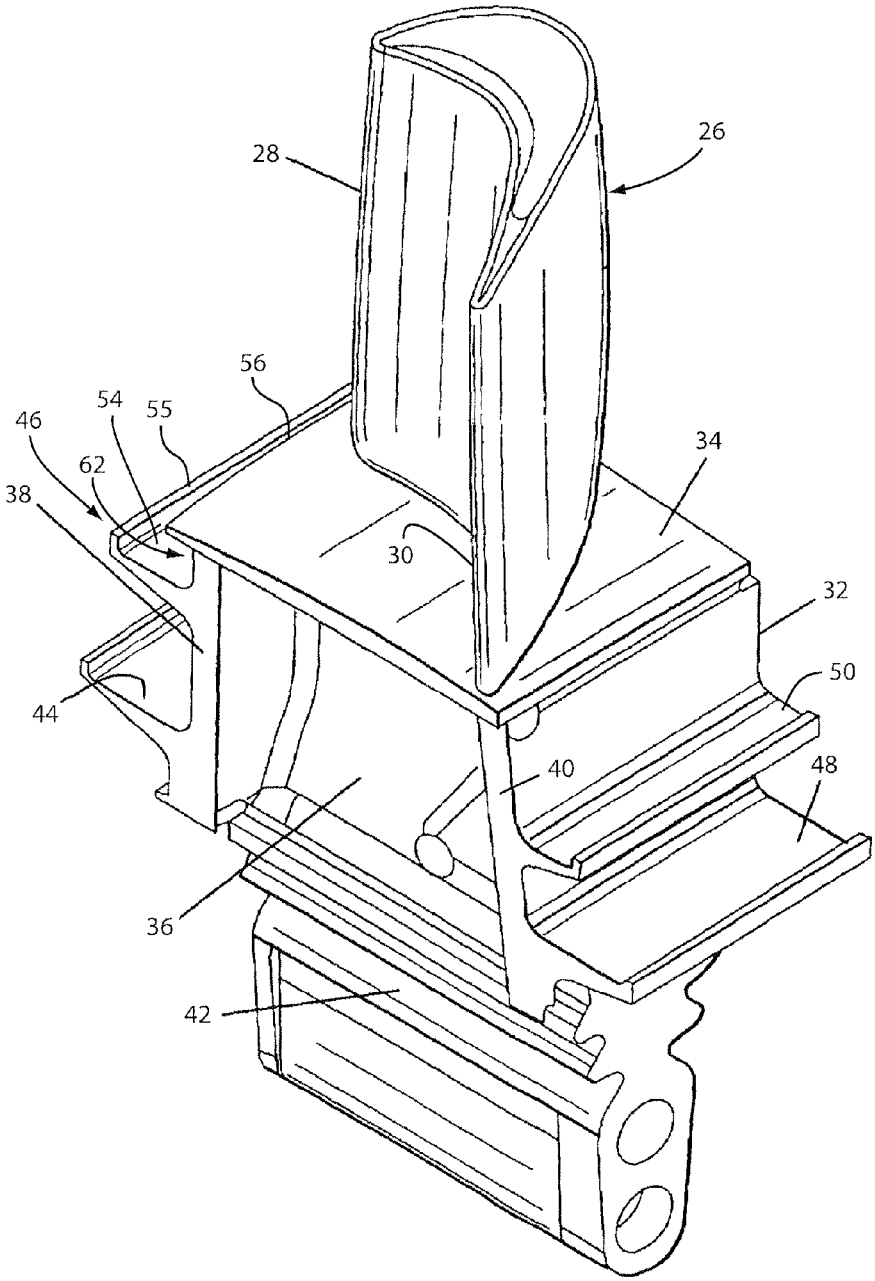
FIG. 2 (PRIOR ART)
FIG. 2 is an enlarged perspective view of a turbine blade.

Referring to FIG. 2, each bucket (for example, bucket 22 of FIG. 1) includes an airfoil 26 having a leading edge 28 and a trailing edge 30, mounted on a shank 32 including a platform 34 and a shank pocket 36 having integral cover plates 38, 40. A dovetail 42 is adapted for connection with generally corresponding dovetail slots formed on the rotor wheel 12 (FIG. 1). Bucket 22 is typically integrally cast and includes axially projecting angel wing seals 44, 46 and 48, 50. Seals 46, 48 and 50 cooperate with lands 52 (see FIG. 1) formed on the adjacent nozzles to limit ingestion of the hot gases flowing through the hot gas path, generally indicated by the arrow 39 (FIG. 1), from flowing into wheel spaces 41.

Of particular concern here is the upper or radially outer angel wing seal 46 on the leading edge end of the bucket. Specifically, the angel wing 46 includes a longitudinal extending wing or seal flange 54 with an upturned edge 55. The bucket platform leading edge 56 extends axially beyond the cover plate 38, toward the adjacent nozzle 18. The upturned edge 55 of seal flange 54 is in close proximity to the surface 58 of the nozzle 18 thus creating a tortuous or serpentine radial gap 60 as defined by the angel wing seal flanges 44, 46 and the adjacent nozzle surface 58 where combustion gas and purge air meet (see FIG. 1). In addition, the seal flange 54 upturned edge 55 and the edge 56 of platform 34 form a so-called "trench cavity" 62 where cooler purge air escaping from the wheel space interfaces with the hot combustion gases. As described further below, by maintaining cooler temperatures within the trench cavity 62, service life of the angel wing seals, and hence the bucket itself, can be extended.

In this regard, the rotation of the rotor, rotor wheel and buckets create a natural pumping action of wheel space purge air (secondary flow) in a radially outward direction, thus forming a barrier against the ingress of the higher temperature combustion gases (primary flow). At the same time, CFD analysis has shown that the strength of a so-called "bow wave," i.e., the higher pressure combustion gases at the leading edge 28 of the bucket airfoil 26, is significant in terms of controlling primary and secondary flow at the trench cavity. In other words, the higher temperature and pressure combustion gases attempting to pass through the angel wing gap 60 is strongest at the platform edge 56, adjacent the leading edge 28 of the bucket. As a result, during rotation of the wheel, a circumferentially-undulating pattern of higher pressure combustion gas flow is established about the periphery of the rotor wheel, with peak pressures substantially adjacent each the bucket leading edge 28.

In order to address the bow wave phenomenon, at least to the extent of preventing the hot combustion gases from reaching the angel wing seal flange 54, the platform leading edge 56 is scalloped in a circumferential direction.

Figure 3:
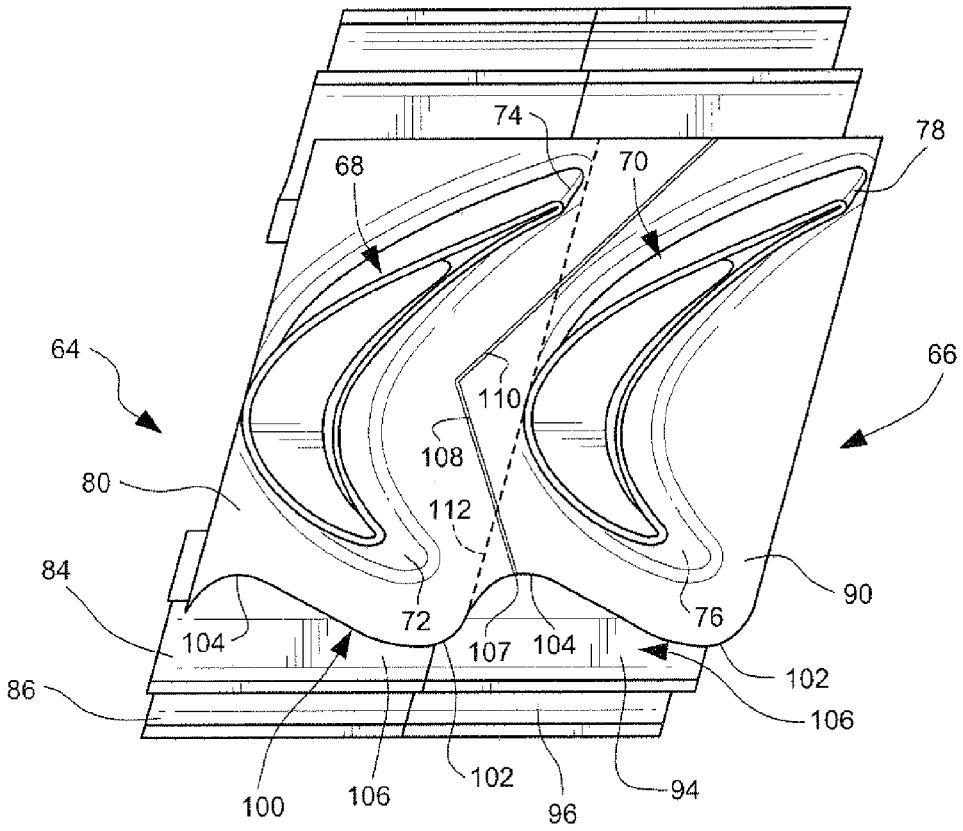
FIG. 3 is a plan view of a turbine bucket pair illustrating a scalloped platform leading edge and a "dog-leg" interface along opposed platform slash faces in accordance with an exemplary but nonlimiting embodiment of the invention.
Figure 4:
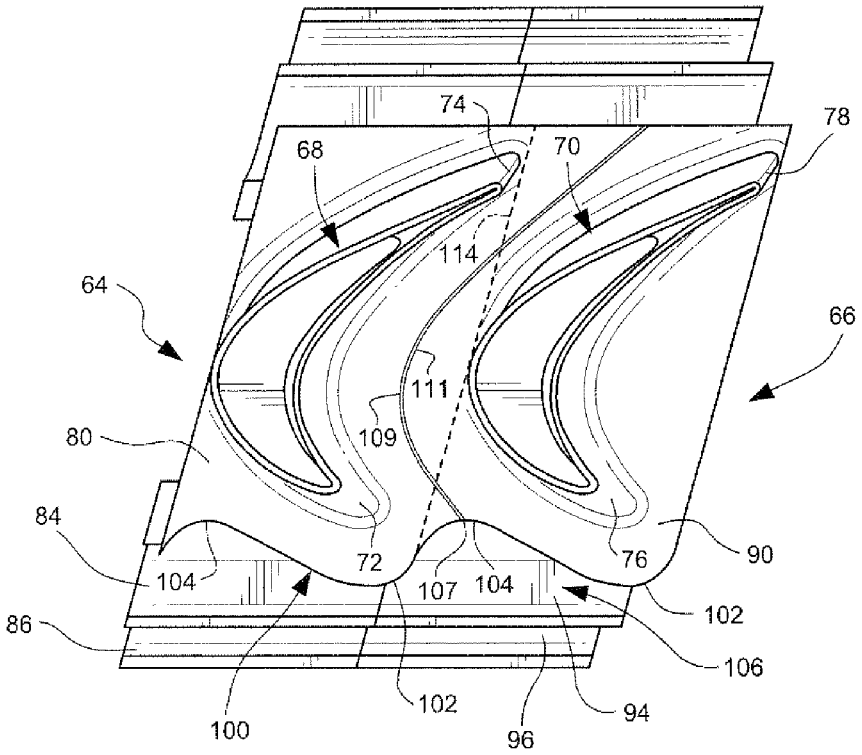
FIG. 4 is a plan view of a turbine bucket pair similar to that shown in FIG. 3 but wherein the interface between opposed slash-faces is formed by a continuous curve.
Figure 5:
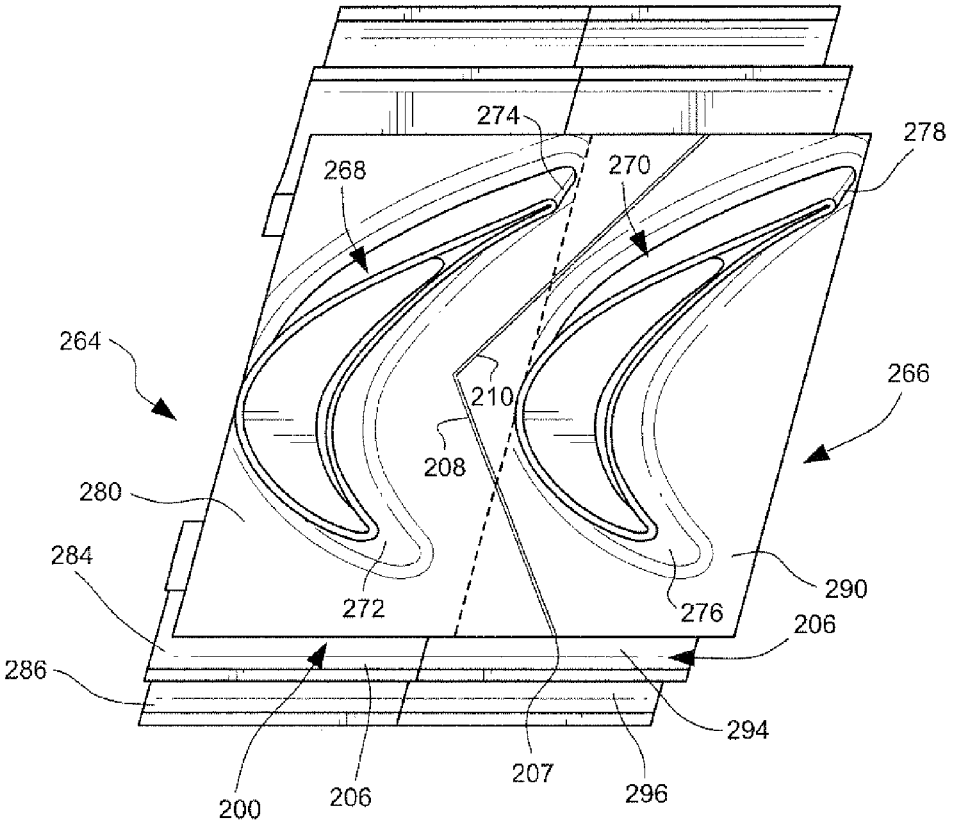
FIG. 5 is a plan view similar to FIG. 3 but omitting the scalloped leading edges along the platforms of the bucket pair.

More specifically, and as best seen in FIGS. 3-5, and 4, a pair of buckets 64, 66 are arranged in side-by-side relationship and include airfoils 68, 70 with leading and trailing edges 72, 74 and 76, 78 respectively. The bucket 64 is also formed with a platform 80, shank (not shown) supporting inner and outer angel wing seal flanges 84, 86 and a dovetail (not shown). Similarly, the bucket 66 is formed with a platform 90, shank (not shown) supporting angel wing seal flanges 94, 96 and a dovetail (not shown). Similar angel wing seals are provided on the trailing sides of the buckets but are no of concern here.

While the buckets 64, 66 are shown as single airfoil buckets, it will be appreciated that the two airfoils may be formed integrally in one bucket shown as a "doublet".

The platform leading edge 100 of the buckets (for convenience, the leading platform edges of the side-by-side buckets will be referred to in the singular, as the leading platform edge 100), in the exemplary but nonlimiting embodiment, is shaped to include an undulating or scalloped configuration defined by a continuous curve that forms substantially axially-oriented projections 102 alternating with recesses 104. The projections 102 extend in an axially upstream direction, adjacent the bucket leading edges 72, 76, thus blocking the flow of hot combustion gases at the bow wave from entering into the trench cavity 106. This continuous curve extends along adjacent buckets, bridging the axial gap 107 extending between adjacent, substantially parallel slash faces 108, 110 of adjacent buckets. The illustrated embodiment thus includes one projection 102 and one recess 104 per bucket. The projections 102 have an axial length dimension less than a corresponding axial length dimensions of the side-by-side angel wing seal flanges 84, 94. For so-called "doublets", where each bucket incorporates two airfoils, there would be two projections and two recesses per bucket.

Thus, it will be appreciated that the projections 102 are located as a function of the strongest pitchwise static pressure defined by the combustion gas bow wave. As can be appreciated, the projections 102 prevent the hot combustion gas vortices from directly impinging on the angel wing seal flanges 84, 94, thus reducing temperatures along the seal flanges. The combustion pressures in the alternating recesses 104 circumferentially between the projections 102 are sufficiently offset by the cooler purge air entering the slash face gap 107 from the wheel space.

FIGS. 3 and 4 also illustrate an additional platform geometry refinement that further enhances the control of cool purge air flow from the wheelspace cavity. Specifically, the opposed slash faces 108, 110 of the adjacent buckets are "dog-leg" shaped as shown in FIG. 3 or continuous curve-shaped as shown in FIG. 4. In this regard, it has been determined that when the slash faces are parallel (as shown by the dashed lines 112, 114, respectively), the aforementioned bow wave pushes hot combustion gas flow into the gap 107 between the slash faces. By changing the shape of the slash face interface to an intersecting-angle or dog-leg shape (FIG. 3) or a continuous curve (FIG. 4), it is possible to locate the entry to the gap 107 within the platform edge recess 104 where the pressure and temperature of the hot gas is reduced as compared to the temperature at the projections 102 corresponding to the bow wave, thus allowing the cooler purge air to effectively combat and prevent combustion gases from entering the gap 107.

In FIG. 3, the slash faces 108, 110 are each formed by straight sections intersecting approximately midway along the length of the slash faces, at an angle of from about 90° to about 120°.

In FIG. 4, the opposed slash faces 109, 111 are shaped to form opposed continuous curves that generally conform the profiles of the adjacent airfoils 68, 70, with substantially the same effect as the intersecting straight-line interface of FIG. 3. Otherwise, for the sake of convenience, the same reference numerals as used in FIG. 3 are used here to designate corresponding components.

In both FIGS. 3 and 4, it will be appreciated that by incorporating mated, angled or curved slash faces, it is not possible to load the buckets onto the turbine disk in an axial direction. Loading in a circumferential direction is required, but that loading format is well known in the art.

Figure 6:
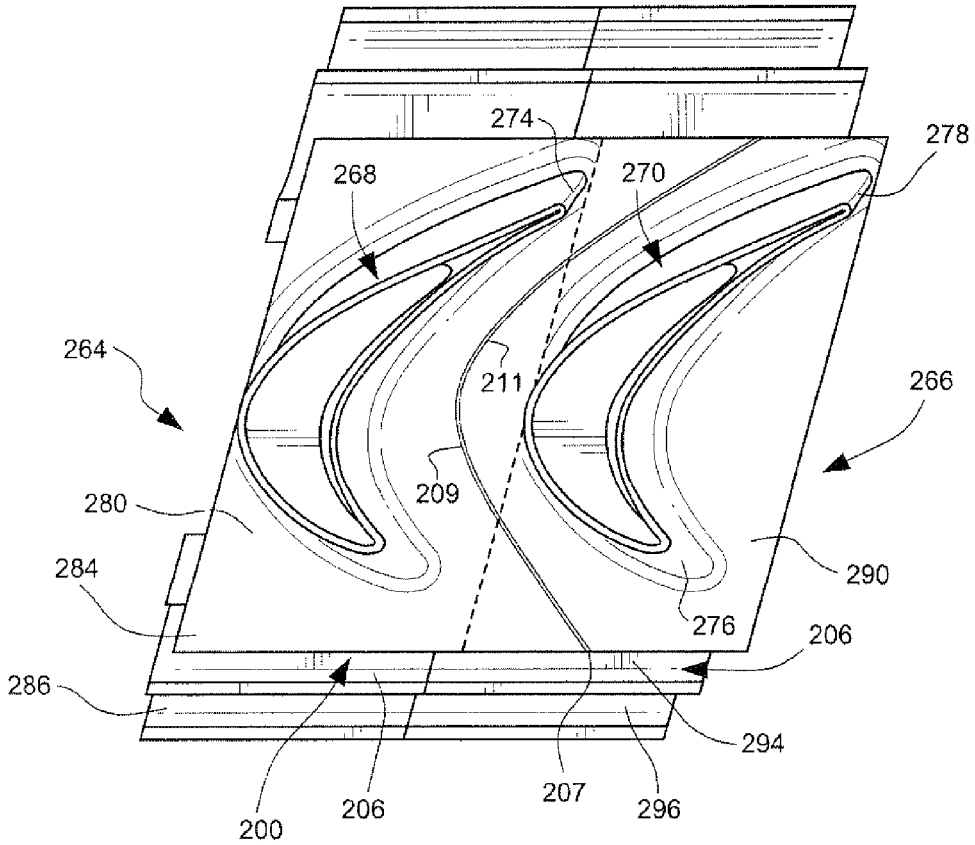
FIG. 6 is a plan view similar to FIG. 4 but omitting the scalloped leading edges along the platforms of the bucket pair.

FIGS. 5 and 6 illustrate similar slash-face arrangements but without the scalloped platform leading edge. In these Figs, Reference numerals similar to those used in FIGS. 3 and 4 (with the prefix "2") are used to designate corresponding components, and only the differences need be described here. More specifically, the platform edge 200 is straight and devoid of any projections or recesses of the scalloped platform edge shown in FIGS. 3 and 4. Nevertheless, the opposed slash faces 208 and 210 remain angled to create a "dog-leg" interface, thereby enabling the gap 207 to be located away or circumferentially offset from the leading edge 272 of the airfoil 268 and the leading edge 276 of the airfoil 270, and hence circumferentially offset from the higher temperature/pressure bow wave. As a result purge air from the wheelspace is able to effectively combat the ingress of hot combustion gases into the gap 207.

In FIG. 6, the opposed slash faces 209, 211 are shaped to form opposed continuous curves that generally conform the profiles of the adjacent airfoils 268, 270, with substantially the same effect as the intersecting straight-line interface of FIG. 5. Otherwise, the buckets are substantially identical, and the same reference numerals used in FIG. 5 are used in FIG. 6 to designate the remaining corresponding components.

Accordingly, the relocation of the entry to the slash face gap 107 or 207 to an area circumferentially offset from the bucket airfoil leading edges in FIGS. 5 and 6 provides the same benefit as described above in connection with FIGS. 3 and 4 but not to the same degree as in FIGS. 3 and 4 where the scalloped leading edge provides additional benefits relating to the control of purge air and hot combustion gases at locations of peak static pressure.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket comprising:

a radially inner mounting portion; a shank radially outward of said mounting portion; at least one radially outer airfoil having a leading edge and a trailing edge; a substantially planar platform radially between said shank and said at least one radially outer airfoil; at least one axially-extending angel wing seal flange on a leading end of said shank thus forming a circumferentially extending trench cavity along said leading end of said shank, radially between an underside of said platform leading edge and a radially outer side of said angel wing seal flange; and slash faces along opposite, circumferentially-spaced side edges of said platform, at least one of said slash faces having a dog-leg shape, a leading end of said at least one of slash face terminating at a location circumferentially offset from said leading edge of said at least one radially outer airfoil; wherein:

the slash face terminates at a first location on a leading edge of the platform and the leading edge of the platform includes an axially extending region and an axially recessed region, and the first location is at the axially recessed region;

the axially recessed region comprises a half of the platform leading edge, the first half of the platform being a half of the leading edge in a direction of rotation of the airfoil;

the axially extending region comprises a second half of the platform leading edge; and the slash face intersects the leading edge within the axially recessed region at an angle such that the slash face projects in the direction of rotation of the airfoil.

2. The turbine wheel of claim 1 wherein when two of said turbine buckets are mounted on a turbine wheel disk in side-by-side relationship, a slash face gap is formed between adjacent slash faces of respective ones of said two turbine buckets, said slash face gap located substantially mid-way between adjacent leading edges of adjacent radially outer airfoils of said two turbine buckets.

3. The turbine wheel of claim 1 wherein said dog-leg shape is composed of first and second substantially straight slash face sections which intersect with the leading and a trailing edge of the platform respectively, and intersect at an angle of between about 90° and 120°.

4. The turbine wheel of claim 1 wherein said dog-leg shape is composed of a continuous curve substantially following a contour of said at least one radially outer airfoil from said leading edge to said trailing edge.

5. The turbine wheel of claim 2 wherein said dog-leg shape is composed of a continuous curves substantially following contours of said adjacent radially outer airfoils.

6. The turbine wheel of claim 2 wherein continuous curve substantially follows contours of said radially outer airfoils of the adjacent buckets.

7. The turbine wheel of claim 1 wherein a leading edge of said platform is scalloped to define alternating projections and recesses.

8. The turbine wheel of claim 7 wherein said slash face gap is located proximate one of said recesses.

9. A turbine wheel comprising a plurality of buckets in a circumferential array about said wheel, each bucket comprising a radially inner mounting portion, a shank radially outward of the mounting portion, a radially outer airfoil and a substantially planar platform radially between said shank and said radially outer airfoil; at least one axially-extending angel wing seal flange on a leading end of said shank thus forming a circumferentially extending trench cavity along the leading end said shank, radially between an underside of the platform leading edge and a radially outer side of the angel wing seal flange; a slash face along opposite, circumferentially-spaced side edges of said platform, at least one of said slash faces having a dog-leg shape, wherein leading ends of said slash faces on adjacent buckets terminate at a location circumferentially offset from the leading edges of adjacent radially outer airfoils, wherein:

the slash face terminates at a first location on a leading edge of the platform; and the leading edge of the platform includes a second half with an axially extending region and a first half with an axially recessed region, wherein the first half is a half of the leading edge in the direction of rotation of the airfoil;

the first location is at the axially recessed region; and the slash face intersects the leading edge within the axially recessed region at an angle such that the slash face projects in the direction of rotation of the airfoil.

10. The turbine wheel of claim 9 wherein adjacent slash faces of respectively adjacent buckets form a slash face gap therebetween, said slashface gap located substantially mid-way between adjacent leading edges of said radially outer airfoils of said adjacent buckets.

11. The turbine wheel of claim 9 wherein said dog-leg shape is composed of first and second substantially straight sections which intersect with the leading and a trailing edge of the platform respectively, and intersect at an angle of between about 90° and 120°.

12. The turbine wheel of claim 9 wherein said dog-leg shape is composed of a continuous curve substantially following a contour of said radially outer airfoil.

13. The turbine wheel of claim 10 wherein said dog-leg shape is composed of a continuous curve substantially following a contour of said radially outer airfoil.

14. The turbine wheel of claim 13 wherein continuous curve substantially follows contours of said radially outer airfoils of the adjacent buckets.

15. The turbine wheel of claim 9 wherein said substantially planar platform has a substantially straight leading edge.

16. The turbine wheel of claim 9 wherein said substantially planar platform has a scalloped leading edge.

17. A method of controlling purge air flow in a radial space between a leading end of a bucket mounted on a rotor wheel and a surface of a stationary nozzle, and wherein the turbine bucket includes a radially inner mounting portion; a shank radially outward of said mounting portion; at least one radially outer airfoil having a leading edge and a trailing edge; a substantially planar platform radially between said shank and said at least one radially outer airfoil; at least one axially-extending angel wing seal flange on a leading end of said shank thus forming a circumferentially extending trench cavity along said leading of said shank, radially between an underside of said platform leading edge and a radially outer side of said angel wing seal flange; and slash faces along opposite, circumferentially-spaced side edges of said platform, the method comprising:

(a) forming opposed slash faces of adjacent buckets to have a substantial dog-leg shape in a substantially axial direction;

(b) locating leading ends of said opposed slash faces circumferentially between leading edges of the respective radially outer airfoils; and (c) locating a first end of the slash face at a first location on a leading edge of the platform;

(d) forming the leading edge of the platform to include an axially extending region along a second half of the leading edge and an axially recessed region along a first half of the leading edge;

(e) locating the first location on the leading edge of the platform at the axially recessed region; and (f) forming the slash face to intersect the leading edge within the axially recessed region at an angle the slash face projects in the direction of rotation of the airfoil.

18. The method of claim 17 wherein said opposed slash faces are substantially dog-leg shaped.

19. The method of claim 17 wherein said substantially planar platform has a substantially straight leading edge.

20. The method of claim 17 wherein said substantially planar platform has a scalloped leading edge.

21. The turbine wheel of claim 1, wherein a leading edge of said platform is scalloped to define alternating projections and recesses in an axial direction.

22. The turbine wheel of claim 21, wherein the slash face terminates on the leading edge of the platform within a recess.

23. The turbine wheel of claim 22, wherein the shape of the slash face substantially follows that of the at least one airfoil.

24. The turbine wheel of claim 9, wherein a leading edge of said platform is scalloped to define alternating projections and recesses in an axial direction.

25. The turbine wheel of claim 24, wherein the slash face terminates on the leading edge of the platform within a recess.

26. The turbine wheel of claim 25, wherein the shape of the slash face substantially follows that of the at least one airfoil.

27. The method of claim 17, wherein the leading edge of said platform is scalloped to define alternating projections and recesses in an axial direction.

28. The method of claim 27, wherein the slash face terminates on the leading edge of the platform within a recess.

29. The method of claim 28, wherein the shape of the slash face substantially follows that of the at least one airfoil.

* * * * *

UNITED STATES PATENT AND TRADEMARK OFFICE

CERTIFICATE OF CORRECTION

PATENT NO. : 8,967,973 B2
APPLICATION NO. : 13/282074
DATED : March 3, 2015
INVENTOR(S) : Ingram It is certified that error appears in the above-identified patent and that said Letters Patent is hereby corrected as shown below:

In the Claims

In Column 6, Line 60, in Claim 1, delete “a half” and insert -- a first half --, therefor.

In Column 8, Line 42, in Claim 17, delete “angle the” and insert -- angle such that the --, therefor.

Signed and Sealed this
Sixth Day of October, 2015

Michelle K. Lee

Michelle K. Lee
*Director of the United States Patent and Trademark Office*